US006609665B2

(12) United States Patent
Fukutomi et al.

(10) Patent No.: US 6,609,665 B2
(45) Date of Patent: Aug. 26, 2003

(54) FUEL INJECTION VALVE

(75) Inventors: Norihisa Fukutomi, Tokyo (JP); Mamoru Sumida, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 66 days.

(21) Appl. No.: 09/850,200

(22) Filed: May 8, 2001

(65) Prior Publication Data

US 2002/0056765 A1 May 16, 2002

(30) Foreign Application Priority Data

Nov. 13, 2000 (JP) ..... P 2000-344657

(51) Int. Cl.[7] ..... B05B 1/34
(52) U.S. Cl. ..... 239/463; 239/585.1
(58) Field of Search ..... 239/463, 472, 239/473, 477, 482, 486, 491, 494, 585.1, 585.5, 533.12, DIG. 19

(56) References Cited

U.S. PATENT DOCUMENTS 5,127,156 A * 7/1992 Yokoyama et al. ..... 29/506
5,280,773 A * 1/1994 Henkel ..... 123/300
5,871,157 A 2/1999 Fukutomi et al. ..... 239/463
5,979,801 A * 11/1999 Munezane et al. ..... 239/463

FOREIGN PATENT DOCUMENTS

JP 5-116163 5/1993 ..... F02M/61/18
JP 5-231266 9/1993 ..... F02M/61/18

* cited by examiner

*Primary Examiner*—Lisa A. Douglas
(74) *Attorney, Agent, or Firm*—Sughrue Mion, PLLC

(57) ABSTRACT

A fuel injection valve for reducing carbon deposit on a passage portion between a seat portion and an injection port. The fuel injection valve includes an injection port 13 for injecting a fuel that is arranged to face a combustion chamber of an internal combustion engine. A seat portion H, where a valve element 8 comes in contact with a face of a valve seat 11 to intermit fuel injection, is arranged at a place upstream the injection port 13. The valve element 8 is conical at a portion downstream the seat portion H to an inlet of the injection port 13. The sectional area of the passage between the valve element 8 and the face of the valve seat 11 at the time of fully opening the valve element 8 is arranged so that the sectional area of the passage downstream of the vicinity of the seat portion H is larger. A tapered face 17 having a bore not more than 1/2.5 of an inner diameter of a swirl chamber 16 of a swirler 10 is formed on the face of the valve seat 11 which is downstream the seat portion H.

2 Claims, 13 Drawing Sheets

FUEL INJECTION VALVE

BACKGROUND OF THE INVENTION

1. Technical Field

The present invention relates to a fuel injection valve that injects a fuel by opening and closing a needle valve.

2. Background Art

FIG. 12 is a sectional view showing a conventional fuel injection valve disclosed in the Japanese Patent Publication (unexamined) No. 47208/1998. In this fuel injection valve, a swirler 22 is disposed upstream an injection port 21, and a valve element 23 has a conical end portion.

The valve is operated as described below. When applying an electric current to a coil 24, an armature 25 is attracted toward a core 26, the needle valve 23 integrally formed with the armature 25 separates from a valve seat 27, and a fuel is injected from a gap between the valve seat 27 and the needle valve 23.

When interrupting the application of electric current to the coil 24, the needle valve 23 is pushed toward the valve seat 27 by a spring 28, and the needle valve 23 comes in contact with the valve seat 27. Opening and closing this needle valve 23 control the amount of fuel to be injected.

Another conventional example is disclosed in the Japanese Patent Publication (unexamined) No. 113163/1993. In this prior art, the valve seat of the fuel injection valve is arranged to have a convex configuration continuously protruding toward the passage, the valve element has a conical end portion, and volume of the passage below the valve element is arranged not to be larger than that in the vicinity of a seat portion (a portion where the valve element comes in contact with the valve seat when the valve is closed) in order to prevent turbulence such as vortex.

The flow of the fuel is accelerated in order to prevent turbulence by continuously reducing the passage area from the seat portion to the injection port.

Since the conventional fuel injection valves has been constructed as described above, the fuel injection valve disclosed in Japanese Patent Publication (unexamined) No. 47208/1998 has a problem that carbon produced in the engine combustion chamber comes to stick onto inner wall face of the injection port 21 of the fuel injection valve and onto the face of the valve seat 27 as shown in FIG. 13. This causes lowering in flow rate and change in spray angle.

Particularly on the valve seat 27 facing immediately downstream a seat portion C, carbon deposit W sticks considerably to a portion D where the swirling force is not sufficiently amplified. This portion is smaller than the injection port 21 in sectional area of the passage, and therefore the carbon sticking brings about a serious influence of reduction in flow rate.

FIG. 14 is a graph showing the relation between several points from a swirl-generating portion A to a downstream point F and flow velocity of swirl.

Next, in the case that the fuel injection valve is constructed as disclosed in the Japanese Patent Publication (unexamined) No. 113163/1993, function of the accelerated flow of the fuel, i.e., fuel flow at a high speed is advantageous in the aspect of effectively washing out the carbon in the area from the seat portion to the injection port. Accordingly, there is a possibility that the problem incidental to the Japanese Patent Publication (unexamined) No. 47208/1998 be solved by such construction as disclosed in the Japanese Patent Publication (unexamined) No. 113163/1993.

Generally in the fuel injection valve provided with a fuel swirl generating portion upstream the injection port, it is desirable that the flow rate at the time of fully opening the valve is decided depending upon the swirling force generated at the swirl generating portion and the inner diameter of the injection port. However, when the sectional area of passage is established to be not larger than a predetermined value in the seat portion between the swirl generating portion and the injection port or in the portion downstream thereof, the flow rate at the time of fully opening the valve is reduced, the swirling force is also decreased, and the injected fuel is not satisfactorily turned into minute particles.

Therefore, it is necessary that sectional area of the passage in the seat portion and the portion downstream the seat portion is established to be larger than a predetermined value. But when the sectional area of passage in the seat portion is excessively large, stroke of the valve element becomes large and response characteristic is deteriorated.

However, when forming the sectional area of passage in the portion downstream the seat portion to be smaller than that of the seat portion as is done in the fuel injection valve proposed by the Japanese Patent Publication (unexamined) No. 113163/1993, the inlet portion of the injection port has the minimum sectional area of passage. The sectional area of passage in the inlet portion of the injection port is decided depending upon configuration of the portion connecting the valve seat face and the injection port, configuration of the valve element, and stroke of the valve element. Hence, it is difficult to control the sectional area of passage with a small tolerance in mass production.

Likewise, it is also difficult to control a passage sectional area of the seat portion, which is larger than that in the inlet portion of the injection port, with a small tolerance. As a result, the passage sectional area of the seat portion is arranged so large as to have a certain clearance, and such a construction is not free from deterioration in response characteristic.

SUMMARY OF THE INVENTION

The present invention was made to resolve the above-discussed problems and has an object of reducing carbon deposit sticking to the passage portion downstream the seat portion between the seat portion and the injection port without deterioration in response characteristic.

A fuel injection valve according to claim 1 of the invention comprises: a hollow valve holder, a valve seat portion mounted on an end of the valve holder and provided with an injection port, a valve element for opening and closing the injection port by moving in the valve holder to come in contact with and separate from the valve seat portion, and a swirler disposed surrounding the valve element to slidably support the valve element and swirling a fuel flowing out of the injection port;

wherein a part of valve seat face downstream a seat portion, where the valve element comes in contact with the valve seat to interrupt fuel injection, is formed into a tapered face.

As a result, it is possible to reduce carbon deposit sticking to the passage portion.

In the fuel injection valve according to claim 2 of the invention, diameter of a starting point upstream the tapered face is established to be not more than 1/2.5 of an inner diameter of a swirl chamber of the swirler.

As a result, lowering in flow rate at the time of fully opening the valve can be restricted to an allowable value or less.

In the fuel injection valve according to claim 3 of the invention, a step portion is formed at a part where the tapered face and the valve seat face join together.

As a result, it is possible to improve function of shearing carbon deposit.

In the fuel injection valve according to claim 4 of the invention, the injection port is arranged to be inclined with respect to a center axis of the valve.

As a result, it is possible to ease uneven fuel flow in the injection port.

DESCRIPTION OF THE PREFERRED EMBODIMENTS

Embodiment 1

Figure 1:
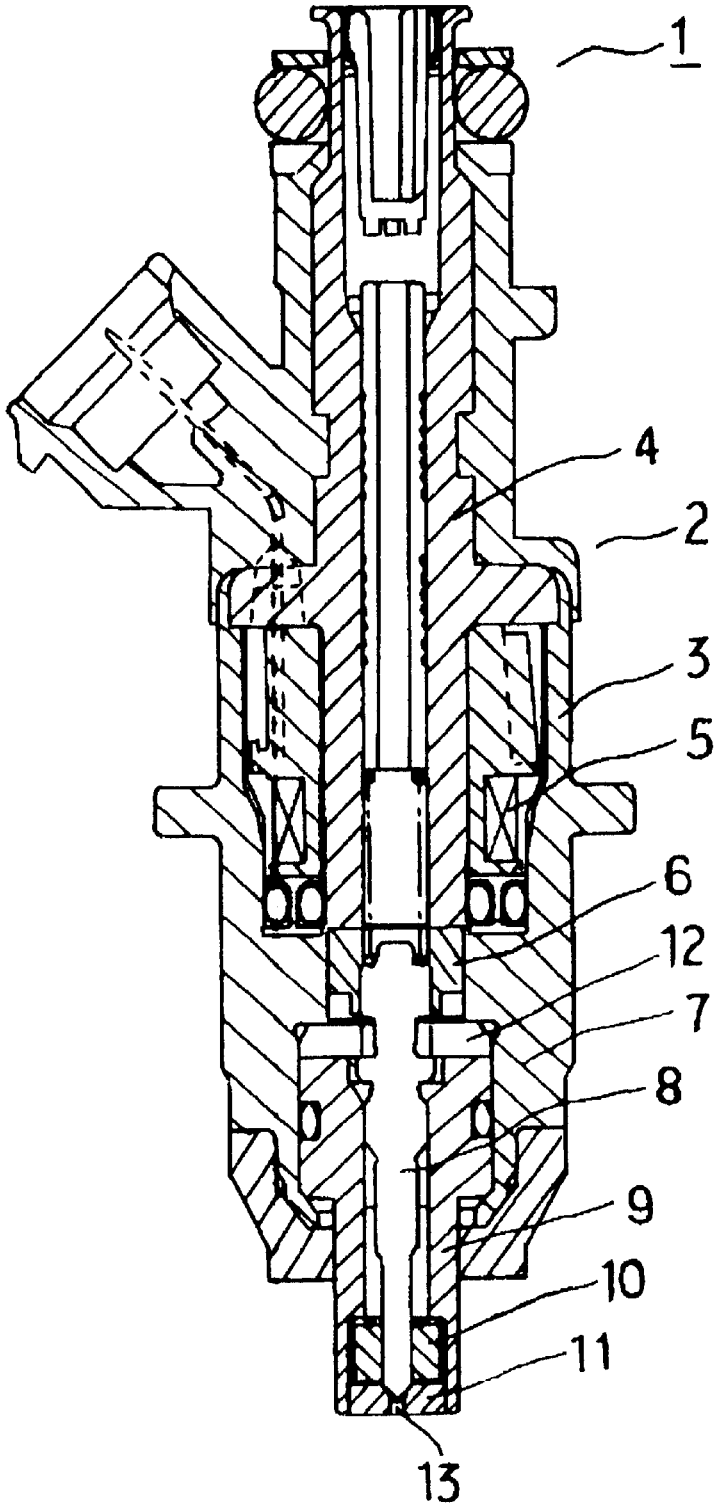
FIG. 1 is a sectional view showing a fuel injection valve according to Embodiment 1 of the invention.
Figure 2:
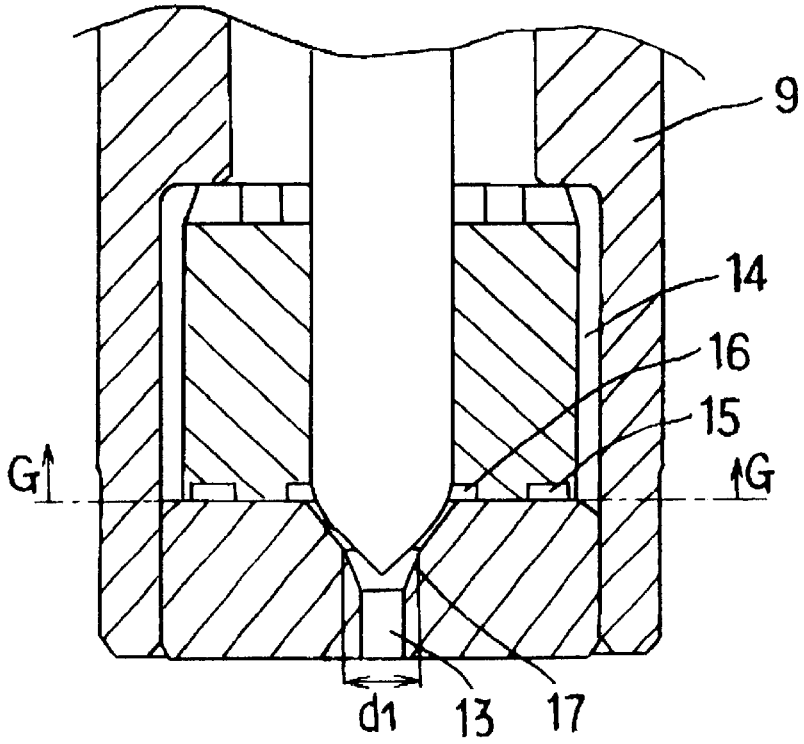
FIG. 2 is an enlarged sectional view showing a valve gear portion of the fuel injection valve according to Embodiment 1 of the invention.
Figure 3:
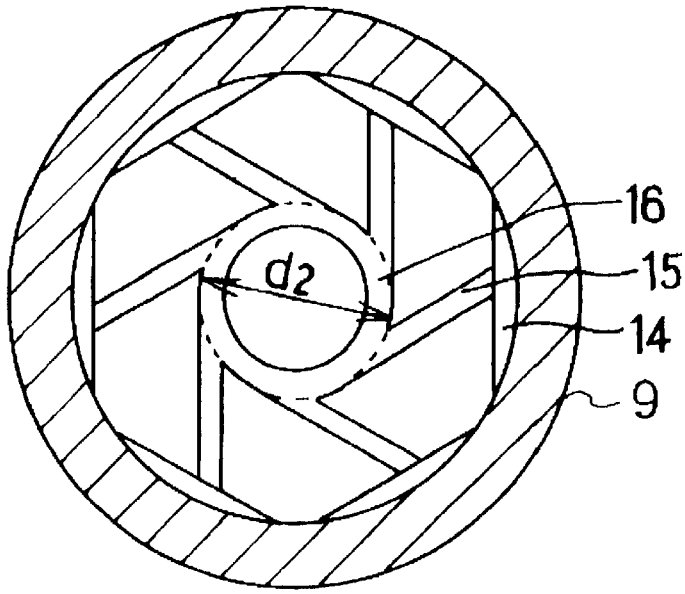
FIG. 3 is a sectional view taken along the line G—G of FIG. 2.
Figure 4:
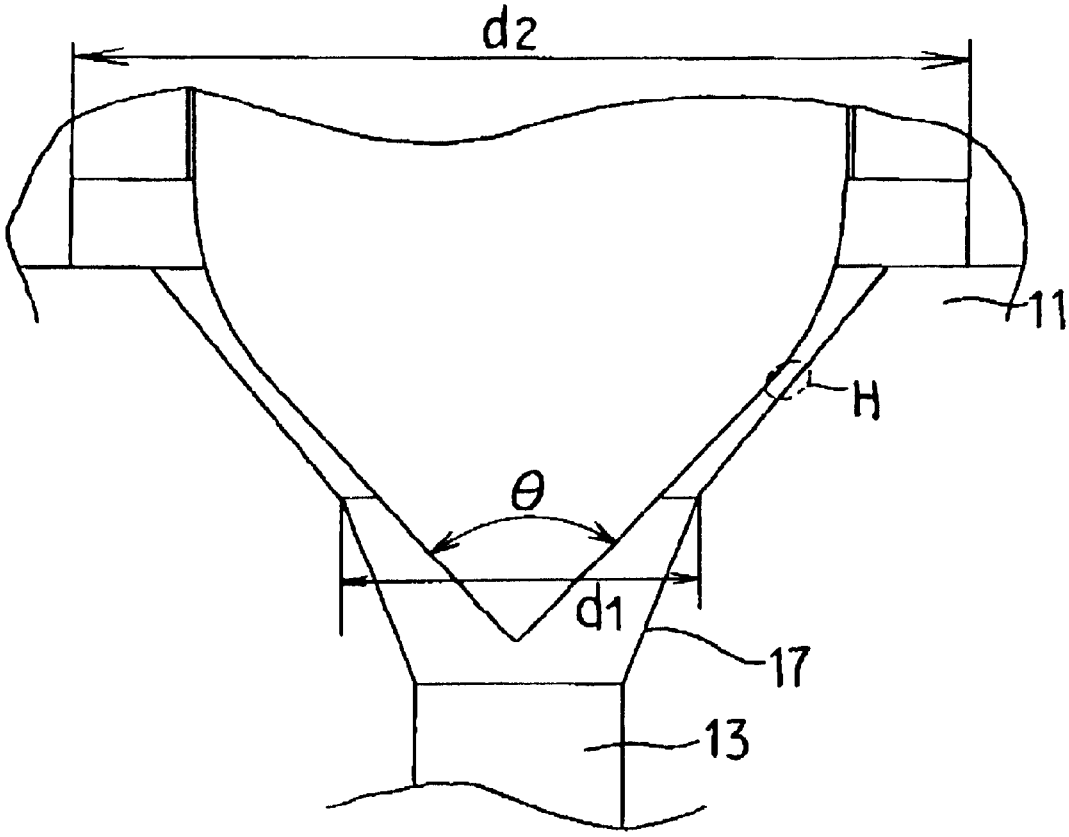
FIG. 4 is an enlarged view showing an end portion of a valve element.

FIG. 1 is a sectional view showing a fuel injection valve according to Embodiment 1 of the invention, FIG. 2 is an enlarged sectional view showing a valve gear portion of the fuel injection valve, FIG. 3 is a sectional view taken along the line G—G of FIG. 2, and FIG. 4 is an enlarged view showing an end portion of a valve element.

In the drawings, reference numeral 1 is a fuel injection valve, numeral 2 is a solenoid, numeral 3 is a housing, numeral 4 is a core, numeral 5 is a coil, numeral 6 is an armature, and numeral 7 is a valve gear. This valve gear 7 is comprised of a valve element 8, a valve holder 9, a swirler 10, a valve seat 11, and a stopper 12.

The valve holder 9 is connected to an end of the housing 3 by caulking, and the armature 6 is connected to the valve element 8 by welding. The swirler 10 is press-fitted in an inner diameter portion of the valve holder 9, and after the valve seat 11 is press-fitted in the inner diameter portion, the valve seat 11 is fixed on the valve holder 9 by welding, thus the valve gear 7 being assembled.

Now, operation of the fuel injection valve of above construction is hereinafter described.

When a microcomputer for controlling an engine transmits an operation signal to a drive circuit of the fuel injection valve, an electric current is applied to the coil 5 of the fuel injection valve, magnetic flux is generated in a magnetic circuit formed by the armature 6, core 4 and housing 3. The armature 6 is attracted toward the core 4, and the valve element 8 formed integrally with the armature 6 separates from the valve seat 11 to form a gap. In this manner, the high-pressure fuel is injected from inside of the valve holder 9 through the injection port 13 of the valve seat 11 into a combustion chamber of an internal combustion engine.

The swirler 10 is disposed in the space from the valve holder 9 to the injection port 13. After flowing into the outer peripheral gap portion 14 of the swirler 10, the fuel is introduced through a swirl groove 15 to the vicinity of center axis of the fuel injection valve again, and a swirl flow is generated in a swirl chamber 16. This swirl flow passes through the seat portion, turns into a spiral flow with a hollow in the injection port 13, and is injected to the combustion chamber in the form of cone-like spray.

In this embodiment, a passage sectional area in the vicinity of the injection port 13 is secured by diminishing a vertex angle θ of a cone of the valve element 8 thereby diminishing the sectional area of passage near the seat portion H and downstream the seat portion H, and forming a tapered face 17 on the injection port 13 side of the valve seat 11 face. A diameter d1 of the starting point on the upstream side of the tapered face 17 is arranged to be not more than 1/2.5 of an inner diameter d2 of the swirl chamber of the swirler 10.

The valve element 8 in this embodiment is R-shaped in order to seal the fuel flow at the seat portion H. However, the portion downstream the seat portion H is cone-shaped or conical, and the conical portion extends to the end.

The passage sectional area between the valve element 8 and the valve seat 11 is decided depending upon this conical portion. Therefore it is not always necessary that the conical portion extends to the end as shown in the drawing as long as the conical portion extends to the vicinity of the inlet of the injection port 13.

The passage sectional area is adjusted by changing the vertex angle of the cone of the valve element 8. Therefore, the seat portion H is arranged not to be located on the extension of the cone-shape so that the diameter of the seat portion H is prevented from being influenced by the change of the vertex angle of the cone. Further, the valve element 8 is R-shaped in order to seal the fuel.

Instead of the R-configuration of this R-configuration portion, it is also preferable to form a further tapered portion other than the conical portion and utilize the tapered portion and its vicinity as seat portion.

Figure 5:
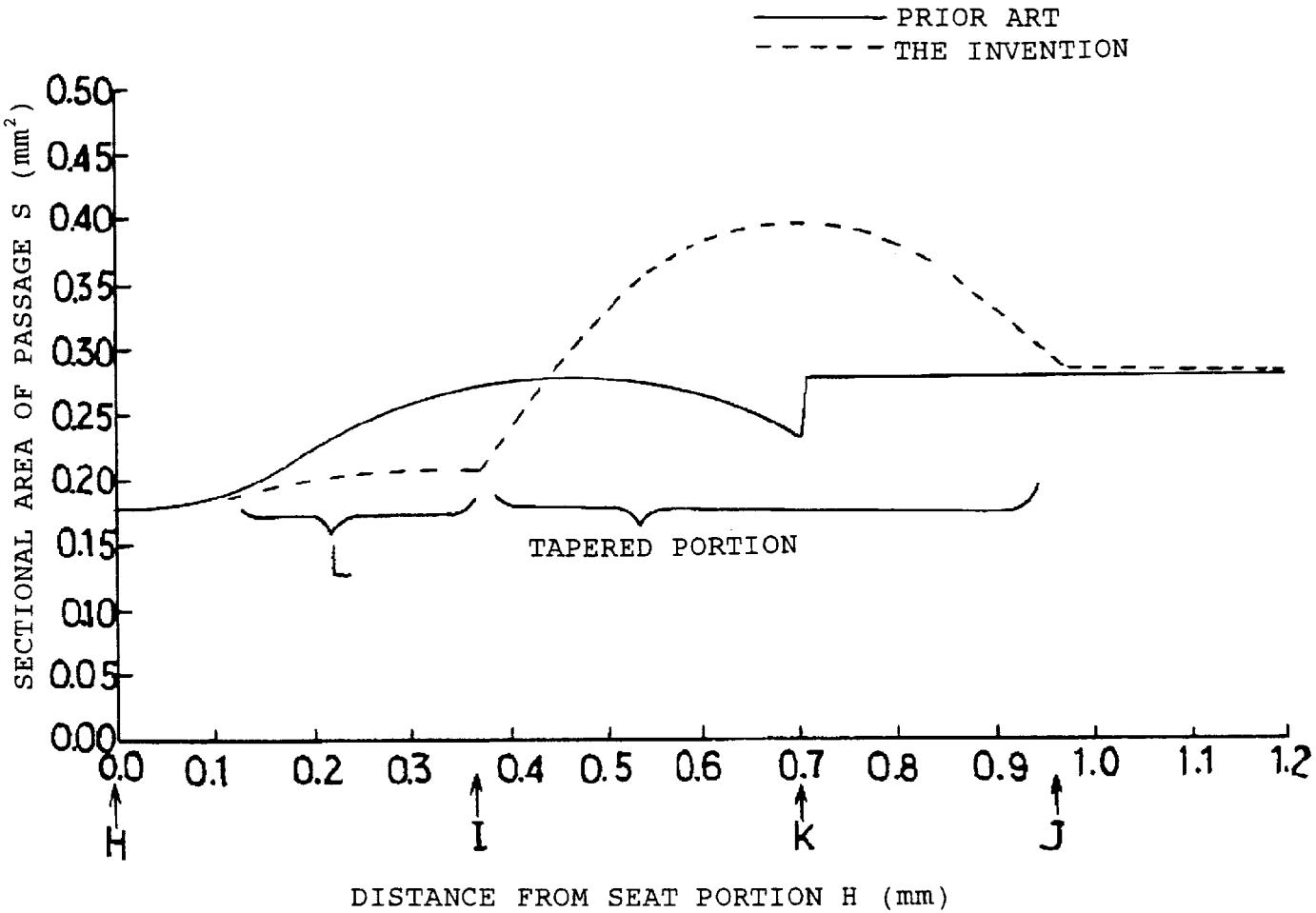
FIG. 5 is a diagram showing a relation between position downstream a seat portion and sectional area of passage.

FIG. 5 shows a comparison between the change in the sectional area of passage from the seat portion H to the injection port 13 portion in this embodiment and that in the prior art. In the drawing, reference I is an inlet portion of the tapered face 17, reference J is an inlet portion of the injection port 13, and reference K is an inlet portion of the injection port in the prior art. A portion L just downstream the seat portion has a sectional area of passage smaller than that in the prior art and the fuel flows at a high speed. Accordingly, the washing effect greatly acts on this portion. Since the tapered face 17 is formed, it becomes possible to prevent the sectional area of passage in the vicinity of the injection port 13 from being smaller than the sectional area of passage in the vicinity of the seat portion.

Figure 6:
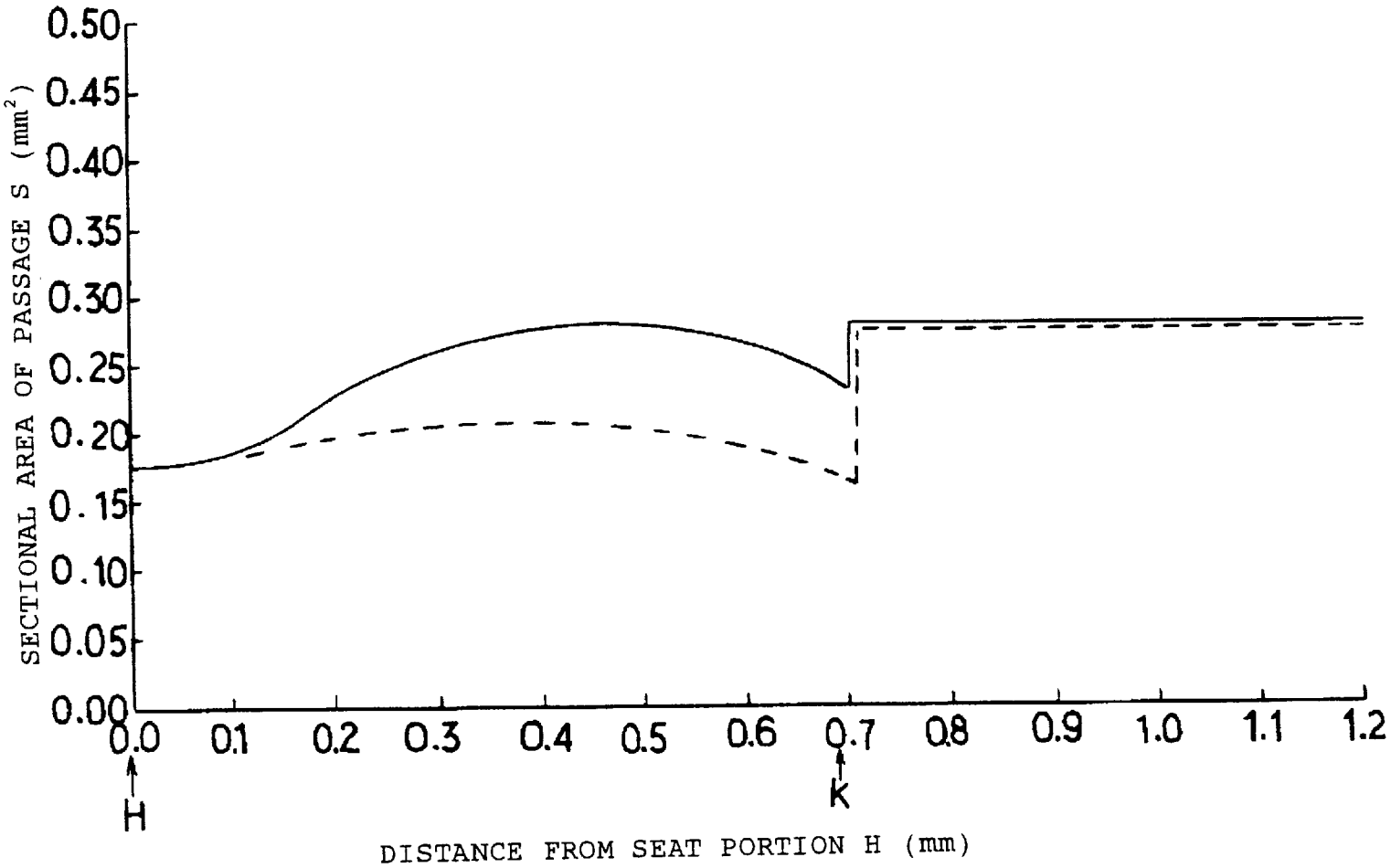
FIG. 6 is a diagram showing a relation between positions downstream the seat portion and sectional area of passage.

FIG. 6 shows, just for comparison, a change in sectional area of passage in the case that no tapered face is formed. In the drawing, a solid line indicates a conventional example, and a one-dot chain line indicates an arrangement in which only the conical angle of the valve element is diminished without any tapered face in comparison with the conventional example.

Since no tapered face is formed as shown in the drawing, the sectional area of passage in the vicinity of the injection port inlet portion K is smaller than that in the vicinity of the seat portion H. Accordingly, it is not possible to control the sectional area of passage at the seat portion H in this structure, from which it is understood that this example is not desirable.

Described below is establishment of bore of the tapered face.

In this invention, since the sectional area of passage in the tapered face 17 is large, it seems apparently that the washing effect is lowered due to reduction in simple flow velocity. However, in order to cause the washing effect of the swirl flow of the fuel to act on the face of the valve seat 11 to which carbon deposit sticks remarkably, fuel flow velocity in the swirl direction is designed to be larger than a certain value.

That is, in this type of fuel injection valve utilizing the swirl flow, the product of the flowing velocity in the swirl direction and the radius of the swirl is constant on the law of free vortex. As a result, the swirl flow generated in the swirl chamber increases its swirl flowing velocity as its radius decreases up to reaching the downstream injection port 13, and this improves the effect of washing the inner wall face.

Figure 7:
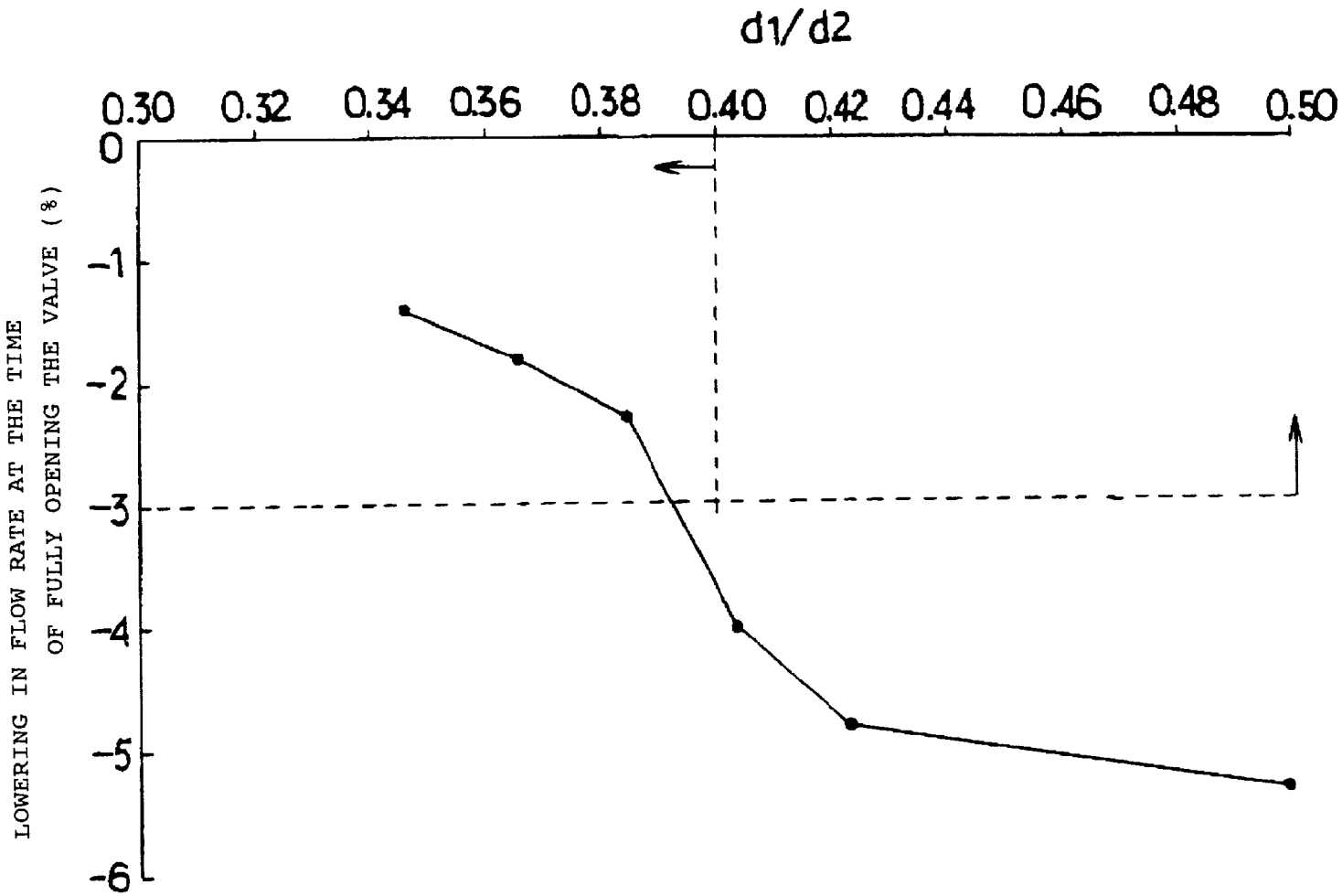
FIG. 7 is a chart showing a relation between d1/d2 and reduction in flow rate at the time of fully opening the valve.

FIG. 7 plots the bore d1 of the tapered face and the lowering in flow rate at the time of fully opening the valve after endurance of engine. The axis of ordinates indicates lowering in flow rate at the time of fully opening the valve, and the axis of abscissas indicates the bore d1 of the tapered face/the inner diameter d2 of the swirl chamber. It is understood from this diagram that the lowering (%) in flow rate at the time of fully opening the valve is reduced to less than the allowable value (−3%) by establishing the bore d1 of the tapered face to be less than approximately 1/2.5 (0.4) of the inner diameter d2 of the swirl chamber.

Figure 8:
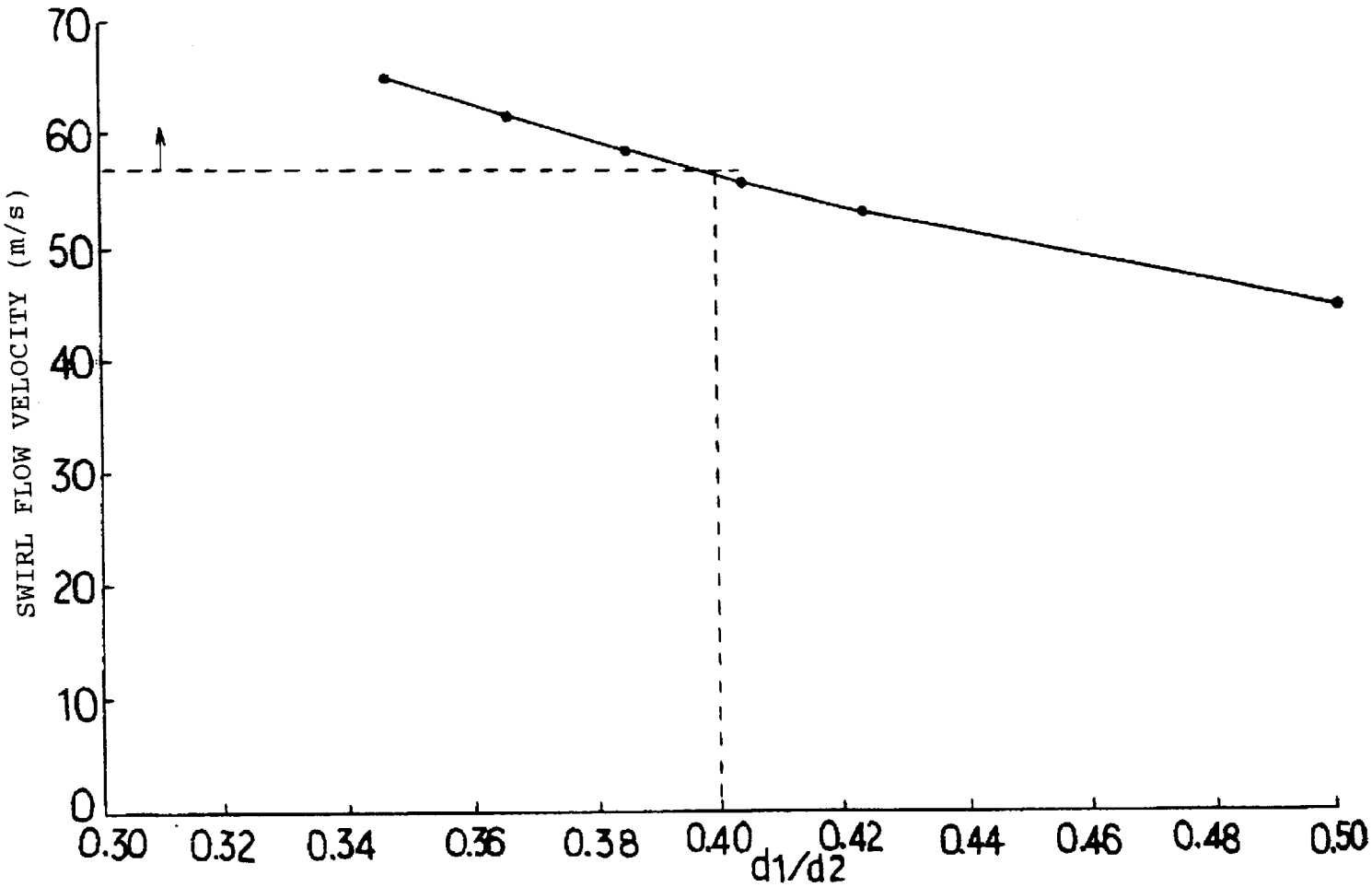
FIG. 8 is a chart showing a relation between d1/d2 and swirl flow velocity.

FIG. 8 shows the relation between the swirl flowing velocity (m/s) at the bore portion of the tapered face and d1/d2. The swirl flow velocity is in inverse proportion to the swirl radius on the law of free vortex. Therefore, a function of restraining lowering in flow rate at the time of fully opening the valve is exhibited by establishing the swirl flow velocity at the bore portion of the tapered face to be not less than a certain value.

As described above, in the invention, in order to increase the effect of washing out the carbon deposit, the vertex angle of the cone of the valve element 8 is established to be smaller than that in the conventional example. The sectional area of the passage in the portion immediately downstream the seat portion H, where the swirl flow velocity is not sufficient, is reduced, and the simple flow velocity is raised. Further, in the vicinity of the inlet of the injection port 13, where the swirl flowing velocity is sufficient, a large sectional area of passage is secured by forming the tapered face 17. This prevents the passage from being blocked due to the reduction in the vertex angle of the valve element 8, thereby avoiding attenuation in the swirl flow.

The sectional area of passage downstream the seat portion H is established to be larger than that of the seat portion H, and the portion having the minimum sectional area of passage between the swirl generating portion and the injection port 13 is utilized as the seat portion H. The sectional area of passage in the seat portion H is substantially in proportion to stroke amount of the valve element 8. Accordingly, it is possible to control the passage sectional area of passage by controlling the stroke, and therefore establishing the stroke of the valve element 8 to be a smaller value ensures the response characteristic.

Furthermore, the starting point on the upstream side of the tapered face 17 is placed at a position of a diameter smaller than 1/2.5 of the inner diameter of the swirl chamber of the swirler 10 based on the experimental value. In such an arrangement, the swirling force of the fuel is sufficiently amplified and carbon deposit on the valve seat 11 face are effectively washed out.

Embodiment 2

Figure 9:
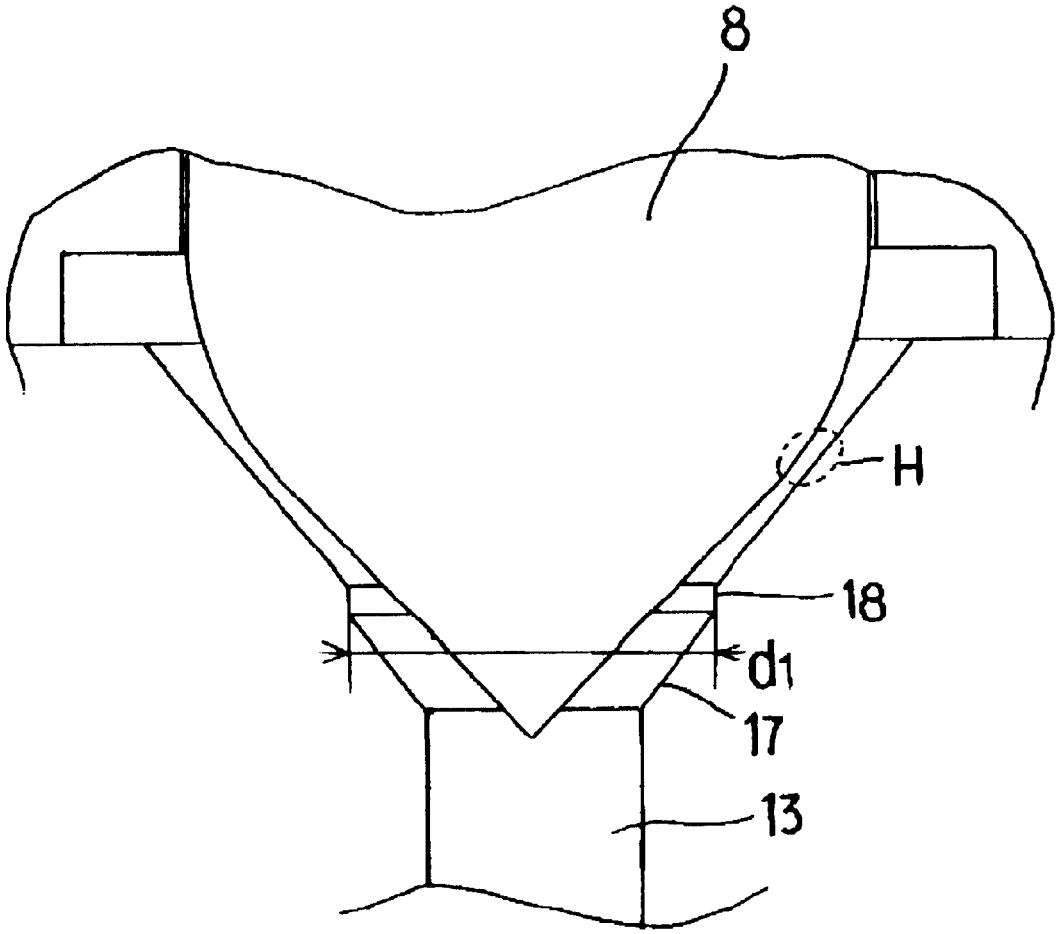
FIG. 9 is an enlarged sectional view showing an end portion of a valve element of a fuel injection valve according to Embodiment 2 of the invention.

FIG. 9 is an enlarged sectional view showing an end portion of a valve element according to Embodiment 2 of the invention. In this embodiment, a step portion 18 is formed at the portion connecting the tapered face 17 and the face of the valve seat 11.

This Embodiment 2 is intended to achieve the advantages similar to those in the foregoing Embodiment 1. When carbon deposit sticks onto the tapered face 17 and the carbon deposit grows extending to the face of the valve seat 11, it is possible to widen the angle of the portion connecting the face of the valve seat 11 and the tapered face 17 by means of the step portion 18. This increases a function of shearing carbon deposit, which is an effective measure against lowering in flow rate.

Figure 10:
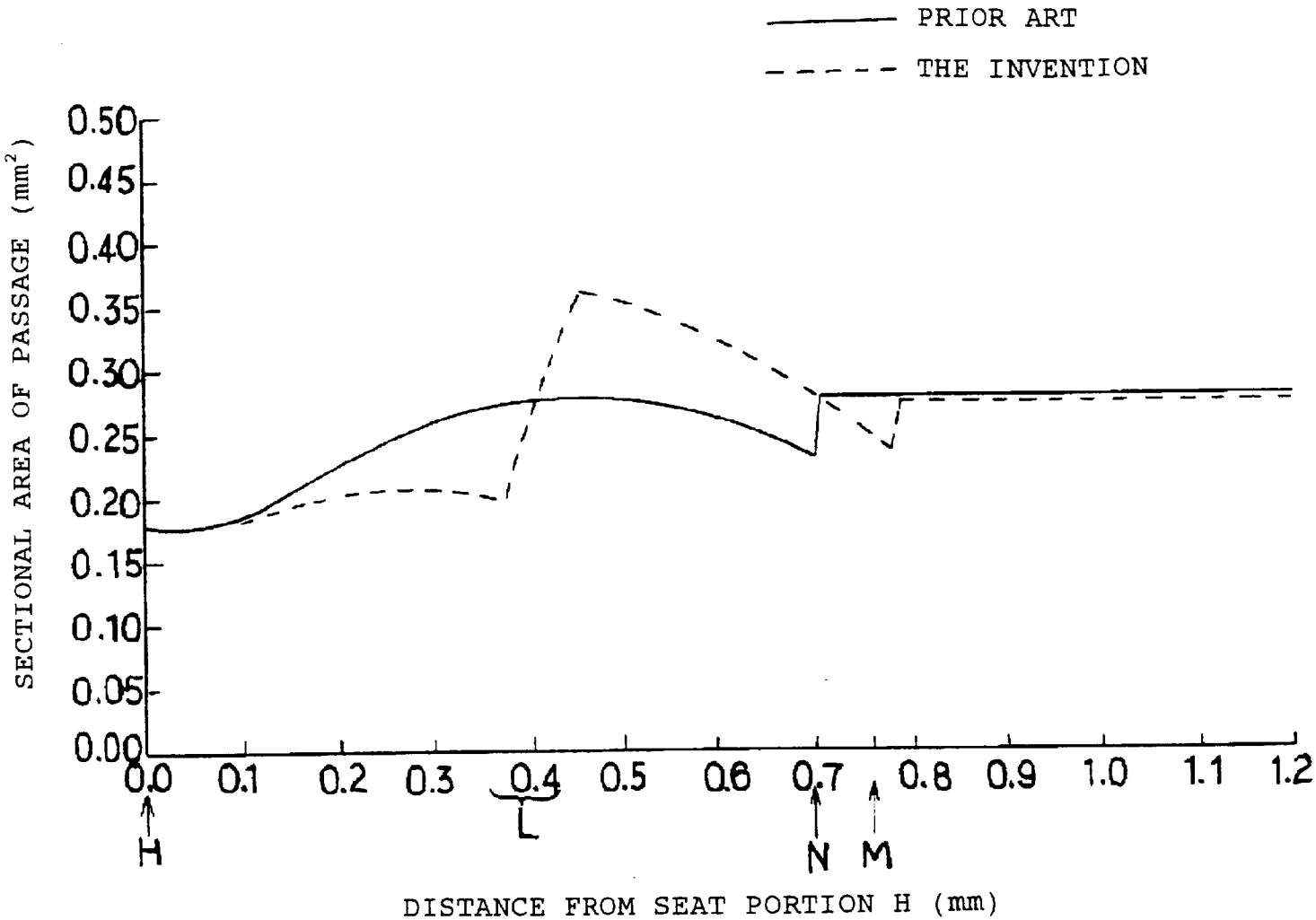
FIG. 10 is a chart showing a relation between position downstream the seat portion and sectional area of passage.

FIG. 10 is a diagram showing the relation between each of positions downstream the seat portion H and sectional area of passage, and in which a solid line indicates a conventional example and a dotted line indicates this embodiment. Reference L shows the step portion 18 in this embodiment, reference M shows an inlet portion of the injection port, and reference N shows an inlet portion of the injection port in the conventional example.

Embodiment 3

Figure 11:
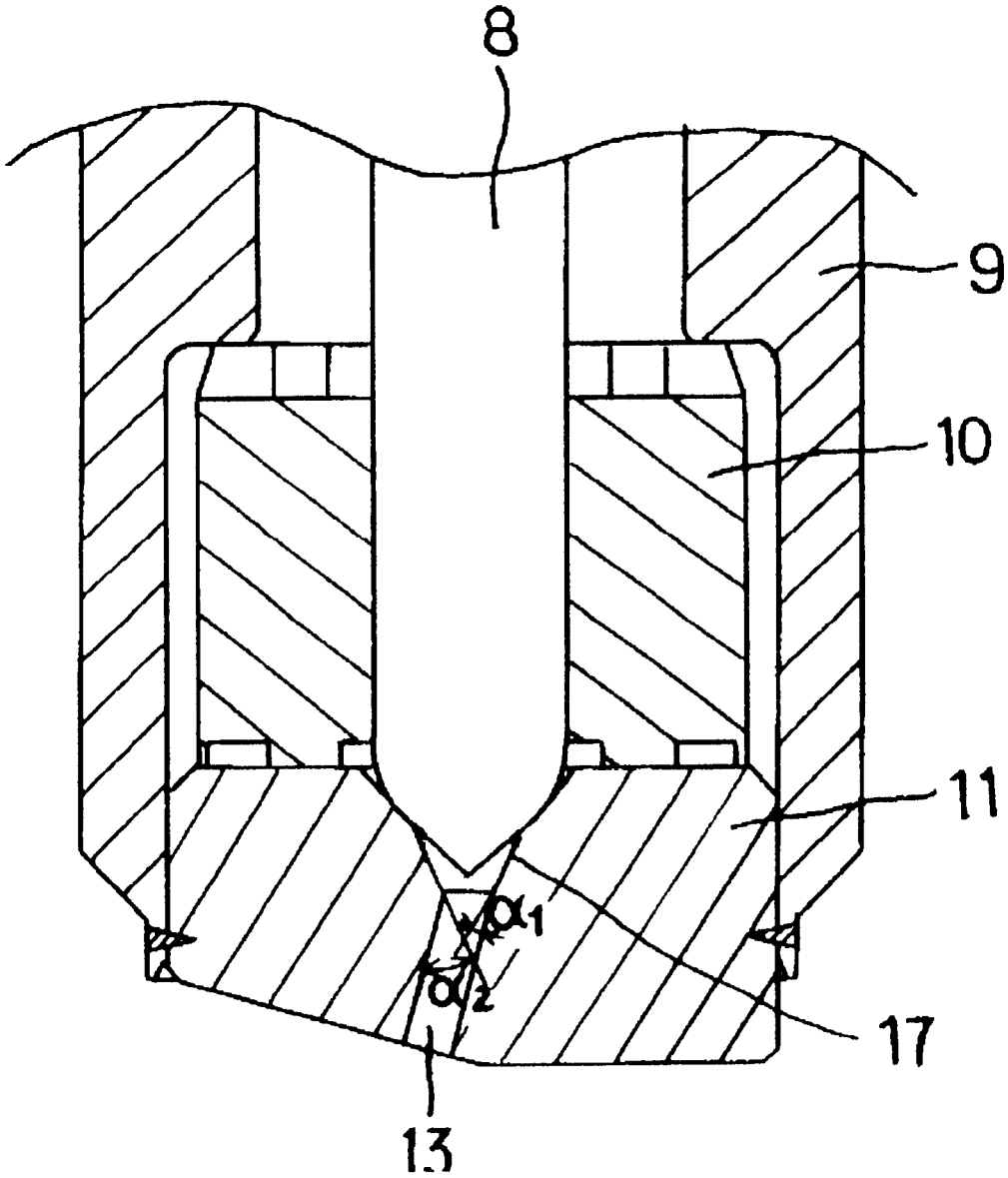
FIG. 11 is an enlarged sectional view showing a valve gear portion of a fuel injection valve according to Embodiment 3 of the invention.
Figure 12:
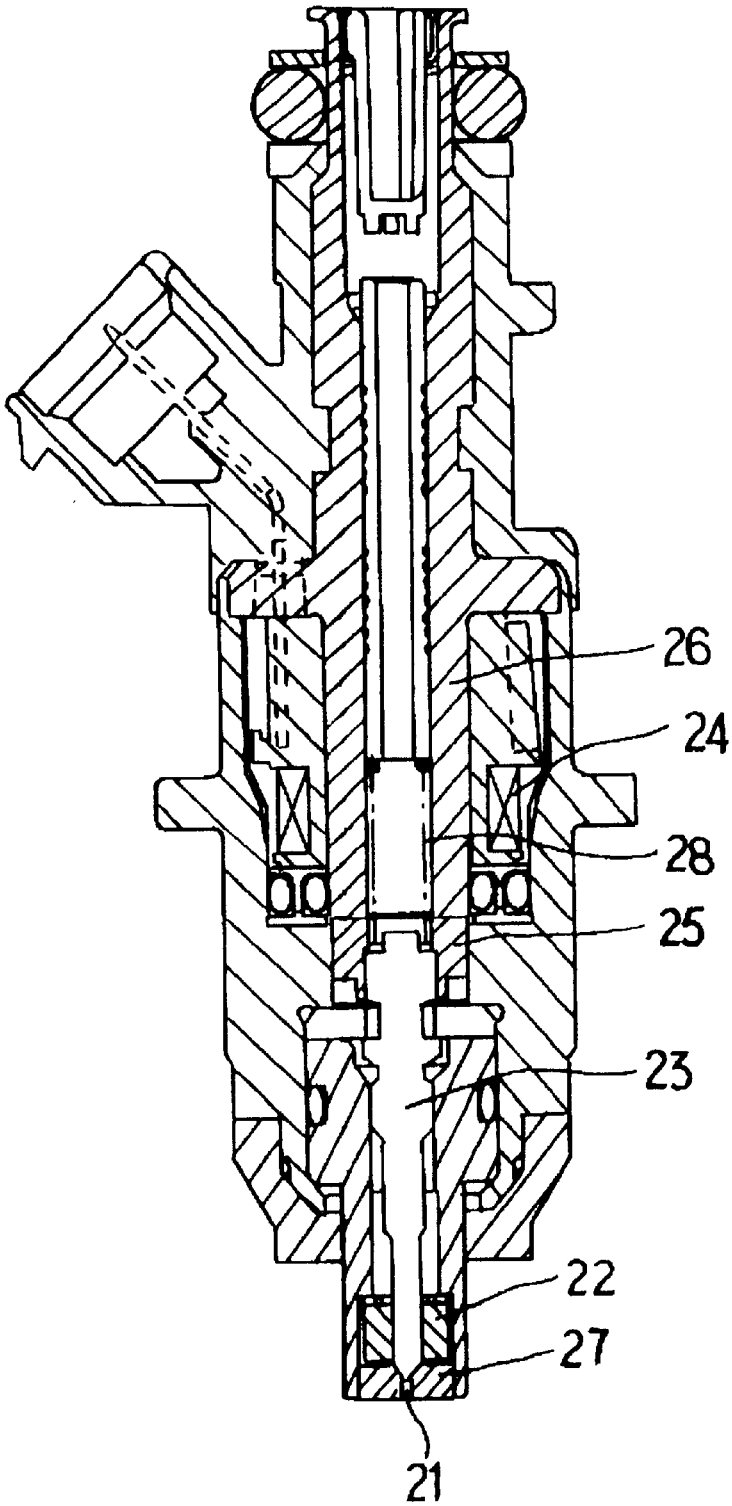
FIG. 12 is a sectional view showing a fuel injection valve according to the prior art.
Figure 13:
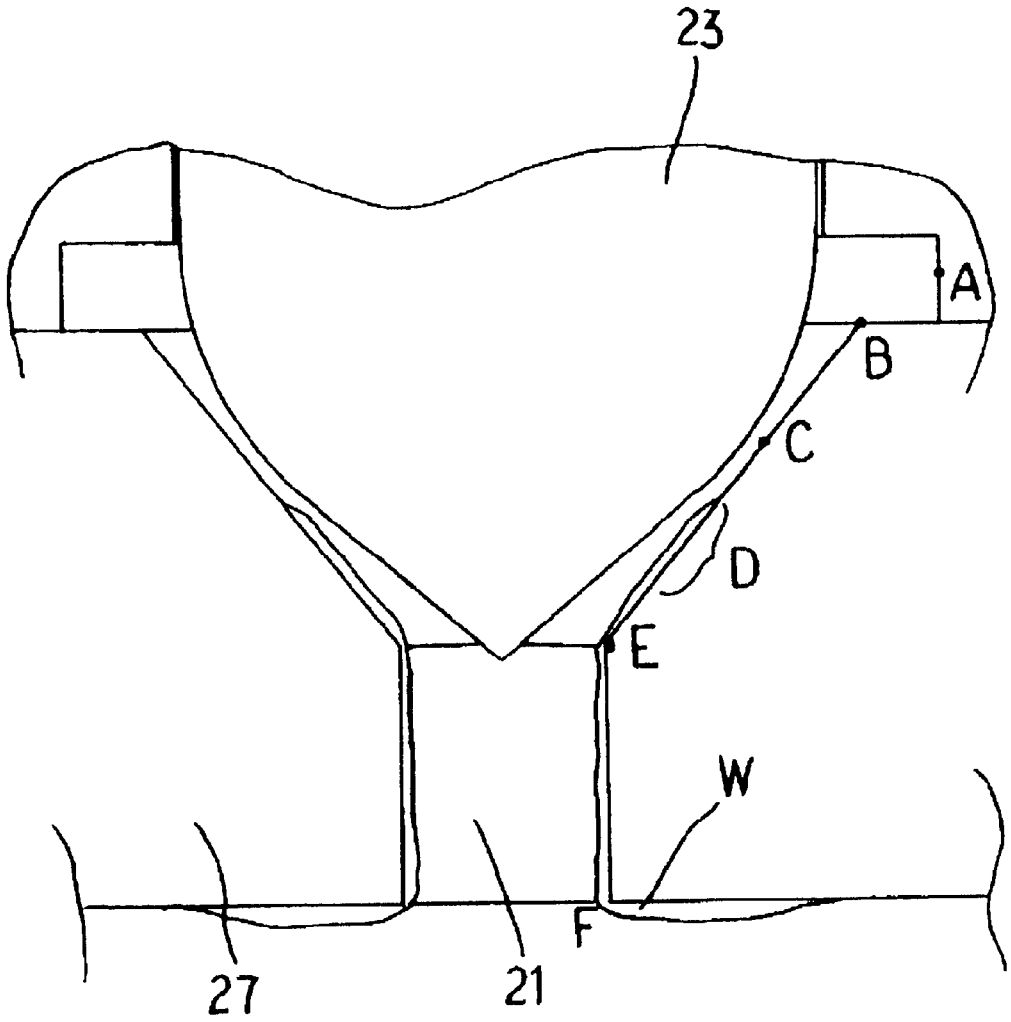
FIG. 13 is an enlarged sectional view showing an end portion of a valve element of the fuel injection valve according to the prior art.
Figure 14:
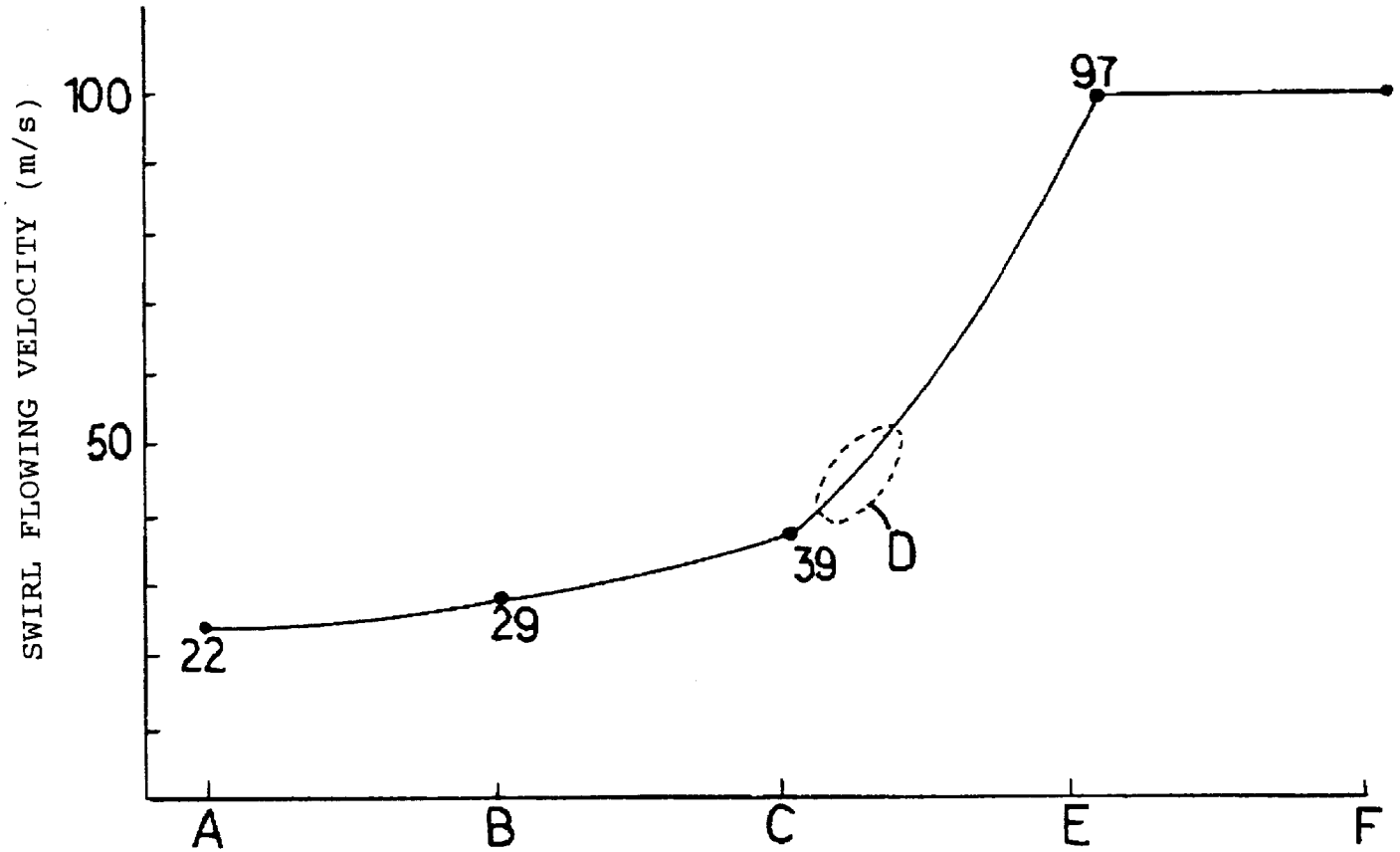
FIG. 14 is a diagram showing a relation between position downstream a swirl generating portion and swirl flow velocity.

FIG. 11 is an enlarged sectional view showing a valve gear portion according to Embodiment 3 of the invention.

In this embodiment, the disclosure in the foregoing Embodiment 1 is applied to a construction in which the injection port 13 is inclined to a center axis of the fuel injection valve.

In such a fuel injection valve of the type having an inclined injection port, there has been heretofore a problem that, in the connecting portion from the face of the valve seat 11 to the injection port 13, there is a difference in angle of refraction. That is, a refraction angle on the left side is different from that on the right ride, and the fuel flow in the injection port 13 becomes uneven in the left and right.

In the drawing, reference numeral $\alpha$1 is a refraction angle on the right side, and reference numeral $\alpha$2 is a refraction angle on the left side.

To cope with the mentioned problem, in this embodiment, the tapered face 17 is formed between the valve seat 11 face and the injection port 13, and it is therefore possible to ease unevenness in fuel flow at the injection port 13 caused by the difference between the foregoing refraction angles $\alpha$1 and $\alpha$2 and improve evenness of the injected fuel, in addition to achieving the advantages of the foregoing Embodiment 1.

It is to be understood that the invention is not limited to the foregoing embodiments and various changes and modifications may be made without departing from the spirit and scope of the invention.

What is claimed is:

1. A fuel injection valve comprising:

a hollow valve holder;

a valve seat mounted on an end of the valve holder, the valve seat comprising:

an injection port;

a first tapered portion where a valve element comes in contact with the valve seat to interrupt fuel injection; and a second tapered portion formed between the first tapered portion and the injection port;

wherein a taper angle of said second tapered portion is different than a taper angle of said first tapered portion; and a swirler disposed surrounding the valve element to slidably support the valve element and to swirl a fuel flowing out of the injection port;

wherein a diameter of a starting point upstream of the second tapered portion is not more than 1/2.5 of an inner diameter of a swirl chamber of the swirler.

2. A fuel injection valve comprising:

a hollow valve holder;

a valve seat mounted on an end of the valve holder, the valve seat comprising:

an injection port;

a first tapered portion where a valve element comes in contact with the valve seat to interrupt fuel injection; and a second tapered portion formed between the first tapered portion and the injection port;

wherein a taper angle of said second tapered portion is different than a taper angle of said first tapered portion; and a swirler disposed surrounding the valve element to slidably support the valve element and to swirl a fuel flowing out of the injection port;

wherein a step portion is formed between the first tapered portion and the second tapered portion.

* * * * *